US012173388B2

(12) United States Patent
Reydet et al.

(10) Patent No.: US 12,173,388 B2
(45) Date of Patent: Dec. 24, 2024

(54) IRON-MANGANESE ALLOY HAVING IMPROVED WELDABILITY

(71) Applicant: APERAM, Luxembourg (LU)

(72) Inventors: Pierre-Louis Reydet, Urzy (FR); Marielle Escot, Saint-Léger-des-Vignes (FR); Nicolas Laurain, Saint-Remy les Chevreuse (FR)

(73) Assignee: APERAM, Luxembourg (LU)

( * ) Notice: Subject to any disclaimer, the term of this patent is extended or adjusted under 35 U.S.C. 154(b) by 652 days.

(21) Appl. No.: 17/423,656

(22) PCT Filed: Jan. 22, 2019

(86) PCT No.: PCT/IB2019/050528

§ 371 (c)(1),
(2) Date: Jul. 16, 2021

(87) PCT Pub. No.: WO2020/152498

PCT Pub. Date: Jul. 30, 2020

(65) Prior Publication Data

US 2022/0162728 A1 May 26, 2022

(51) Int. Cl.

| | |
|---|---|
| ***C22C 38/04*** | (2006.01) |
| ***C21D 8/02*** | (2006.01) |
| ***C21D 8/06*** | (2006.01) |
| ***C21D 9/52*** | (2006.01) |
| ***C22C 38/00*** | (2006.01) |
| ***C22C 38/02*** | (2006.01) |
| ***C22C 38/58*** | (2006.01) |

(52) U.S. Cl.

CPC ..... *C22C 38/04* (2013.01); *C21D 8/0236* (2013.01); *C21D 8/0263* (2013.01); *C21D 8/065* (2013.01); *C21D 9/525* (2013.01); *C22C 38/001* (2013.01); *C22C 38/005* (2013.01); *C22C 38/02* (2013.01); *C22C 38/58* (2013.01); *C21D 2211/001* (2013.01)

(58) Field of Classification Search

None

See application file for complete search history.

(56) References Cited

U.S. PATENT DOCUMENTS

2009/0010793 A1* 1/2009 Becker ..... C21D 6/005 420/56
2015/0020928 A1 1/2015 Lee et al.
2016/0319407 A1 11/2016 Lee et al.

FOREIGN PATENT DOCUMENTS

| | | |
|---|---|---|
| DE | 23 51 234 | 4/1975 |
| EP | 2 799 571 | 11/2014 |
| EP | 3 088 555 | 11/2016 |
| JP | S52 36513 | 3/1977 |
| JP | 2-11723 | 1/1990 |
| JP | 2007-126715 | 5/2007 |
| JP | 2017066470 A * | 4/2017 |

OTHER PUBLICATIONS

English language machine translation of JP-2017066470-A. Generated May 2, 2024. (Year: 2024).*
English language machine translation of DE2351234 A1. Generated May 2, 2024. (Year: 2024).*
International Search Report for PCT/IB2019/050528, dated Aug. 8, 2019, 5 pages.
Written Opinion of the ISA for PCT/IB2019/050528, dated Aug. 8, 2019, 7 pages.

* cited by examiner

*Primary Examiner* — Brian D Walck
(74) *Attorney, Agent, or Firm* — NIXON & VANDERHYE

(57) ABSTRACT

Disclosed is an iron-manganese alloy including, by weight: 25.0%≤Mn≤32.0%; 7.0%≤Cr≤14.0%; 0≤Ni≤2.5%; 0.05%≤N≤0.30%; 0.1≤Si≤0.5%; and optionally 0.010%≤rare earths≤0.14%. The remainder being iron and residual elements resulting from manufacturing.

20 Claims, No Drawings

IRON-MANGANESE ALLOY HAVING IMPROVED WELDABILITY

This application is the U.S. national phase of International Application No. PCT/IB2019/050528 filed 22 Jan. 2019, which designated the U.S. the entire contents of which is hereby incorporated by reference.

BACKGROUND OF THE INVENTION

Field of the Invention

The present invention relates to an iron-manganese alloy intended to be used to manufacture parts and welded assemblies for applications in which high dimensional stability under the effect of variations in temperature, in particular at cryogenic temperature, is required.

The alloy of the invention is more particularly intended to be used in the field of electronics and in cryogenic applications.

Description of the Related Art

The alloys the most frequently used for such applications are nickel-iron alloys and more particularly Invar® alloys generally comprising about 36% nickel. Such alloys have excellent dimensional stability properties, in particular at cryogenic temperature, but have the disadvantage of a cost price that is relatively high, resulting in particular from the relatively high nickel content thereof. In addition, the weldability of these alloys with other metals does not always give full satisfaction, in particular in terms of mechanical strength of the heterogeneous welds.

It is therefore sought, in the present invention, to provide an alloy suitable for the above-mentioned applications, and therefore having good properties particularly at cryogenic temperature whilst being less costly than Invar®.

Iron-based alloys also comprising carbon and manganese are known marketed by the Korean company Posco. These steels comprise, by weight:

- 0.35%≤C≤0.55%
- 22.0%≤Mn≤26.0%
- 3.0%≤C≤4.0%
- 0≤Si≤0.3%
- the remainder being iron and residual elements resulting from manufacturing.

However, these alloys do not give full satisfaction.

Although they are satisfactory with regard to their coefficient of thermal expansion and toughness at ambient temperature and cryogenic temperature (−196° C.), the inventors of the present invention have noted that they exhibit high sensitivity to hot cracking and therefore have relatively poor weldability.

Also, the inventors of the present invention have additionally observed that these steels have high sensitivity to corrosion. Yet good corrosion resistance is of importance for the above-mentioned applications, in particular for thin strips, to limit risks of fatigue fracture or stress rupture of parts and structures manufactured from these alloys. These alloys are therefore not fully satisfactory for the above-mentioned applications.

SUMMARY OF THE INVENTION

It is therefore one objective of the invention to propose an alloy able to be used in satisfactory manner to manufacture parts and welded assemblies for applications in which high dimensional stability is required under the effect of variations in temperature, for example for cryogenic applications, whilst having a relatively low cost price.

For this purpose, the invention relates to an iron-manganese alloy comprising by weight:

- 25.0%≤Mn≤32.0%
- 7.0%≤C≤14.0%
- 0≤Ni≤2.5%
- 0.05%≤N≤0.30%
- 0.1≤Si≤0.5%
- optionally 0.010% rare earths 0.14%
- the remainder being iron and residual elements resulting from manufacturing.

In some particular embodiments, the alloy of the invention comprises one or more of the following characteristics taken alone or in any technically possible combination:

- The chromium content is between 8.5 and 11.5 weight %.
- The nickel content is between 0.5 and 2.5 weight %.
- The nitrogen content is between 0.15 and 0.25 weight %.
- The rare earths comprise one or more elements selected from among: lanthanum, cerium, yttrium, praseodymium, neodymium, samarium and ytterbium.
- The iron-manganese alloy such as described above has a mean coefficient of thermal expansion CTE, between −180° C. and 0° C., lower than or equal to $8.5\times10^{-6}$/° C.
- The iron-manganese alloy such as described above has a Néel temperature $T_{Néel}$ higher than or equal to 40° C.
- The iron-manganese alloy such as described above, when prepared as a thin strip of 3 mm thickness or less, has at least one from among the following characteristics:
  - KCV toughness, on reduced test specimen of 3 mm thickness and at cryogenic temperature (−196° C.), greater than or equal to 80 J/cm$^2$, and for example greater than or equal to 100 J/cm$^2$;
  - yield strength $Rp_{0.2}$ at −196° C. greater than or equal to 700 MPa;
  - yield strength $Rp_{0.2}$ at ambient temperature (20° C.) greater than or equal to 300 MPa.
- The iron-manganese alloy such as described above is austenitic at cryogenic temperature and at ambient temperature.

The invention also relates to a method for manufacturing a strip made from an alloy such as previously defined, the method comprising the following successive steps:

- an alloy such as previously defined is prepared;
- a semi-finished product of said alloy is formed;
- this semi-finished product is hot rolled to obtain a hot rolled strip;
- optionally, the hot rolled strip is cold rolled in one or more passes to obtain a cold rolled strip.

The invention also relates to a strip made from an iron-manganese alloy such as previously defined.

The invention also relates to a method for manufacturing a wire made from an iron-manganese alloy such as previously defined, the method comprising the following steps:

- providing a semi-finished product made from an iron-manganese alloy;
- hot working this semi-finished product to form an intermediate wire; and
- working the intermediate wire into a wire of smaller diameter than the intermediate wire, said working comprising a wire-drawing step.

The invention also relates to a wire made from an iron-manganese alloy such as previously defined.

This wire is particularly a filler wire or wire intended for the manufacture of bolts or screws, these bolts and screws being obtained in particular by cold heading this wire.

DESCRIPTION OF THE PREFERRED EMBODIMENTS

The invention will be better understood on reading the following description given solely as an example.

In the entire description, contents are given in weight percent.

The alloy of the invention is an iron-manganese alloy comprising by weight:

25.0%≤Mn≤32.0%

7.0%≤C≤14.0%

0≤Ni≤2.5%

0.0.%≤N≤0.30%

0.1≤Si≤0.5% optionally 0.010% rare earths 0.14% the remainder being iron and residual elements resulting from manufacturing.

Said alloy is a high-manganese austenitic steel.

The alloy of the invention is austenitic at ambient temperature and at cryogenic temperature (−196° C.).

By residual elements resulting from manufacturing, it is meant elements which are contained in the raw materials used to prepare the alloy or which derive from equipment used for preparation thereof, for example furnace refractories. These residual elements do not have any metallurgical effect on the alloy.

The residual elements notably comprise one or more elements selected from among: carbon (C), aluminium (Al), selenium (Se), sulfur (S), phosphorus (P), oxygen (O), cobalt (Co), copper (Cu), molybdenum (Mo), tin (Sn), niobium (Nb), vanadium (V), titanium (Ti) and lead (Pb).

For each of the residual elements listed above, the maximum contents by weight are preferably selected as follows:

C≤0.05 weight % and preferably C≤0.035 weight %;

Al≤0.02 weight %, and preferably Al≤0.005 weight %;

Se≤0.02 weight %, and preferably Se≤0.01 weight %, more advantageously Se≤0.005 weight %;

S≤0.005 weight %, and preferably S≤0.001 weight %;

P≤0.04 weight % and preferably P≤0.02 weight %;

O≤0.005 weight %, and preferably O≤0.002 weight %;

Co, Cu, Mo≤0.2 weight % each;

Sn, Nb, V, Ti≤0.02 weight % each;

Pb≤0.001 weight %.

In particular, the selenium content is limited to the above-mentioned ranges for the purpose of preventing hot cracking problems which could result from a selenium content that is too high in the alloy.

In particular, the alloy of the invention has:

A mean coefficient of thermal expansion CTE, between −180° C. and 0° C., lower than or equal to $8.5\times10^{-6}$/° C.; and A Néel temperature $T_{Néel}$ higher than or equal to 40° C., and when it is prepared as thin strip of thickness 3 mm or less;

KCV toughness, on reduced test specimen of 3 mm thickness and at cryogenic temperature (−196° C.), greater than or equal to 80 J/cm$^2$, and for example greater than or equal to 100 J/cm$^2$;

Yield strength $Rp_{0.2}$ at −196° C. greater than or equal to 700 MPa; and

Yield strength $Rp_{0.2}$ at ambient temperature (20° C.) greater than or equal to 300 MPa.

Consequently, this alloy has properties of thermal expansion, toughness and mechanical strength that are satisfactory for use thereof in the aforementioned applications, in particular at cryogenic temperature.

The alloy of the invention additionally has a corrosion resistance, characterized by a critical corrosion current in $H_2SO_4$ medium (2 mol·l$^{-1}$), of strictly less than 230 mA/cm$^2$, and a pitting potential V in NaCl medium (0.02 mol·l$^{-1}$) strictly higher than 40 mV, the pitting potential being determined with reference to a standard potential, the standard hydrogen electrode (SHE). The alloy of the invention therefore has corrosion resistance greater than or equal to that of Invar®-M93. It is noted in this context that Invar®-M93 is a material usually used in the aforementioned applications, in particular at cryogenic temperature.

The alloy of the invention also has corrosion resistance that is far greater than that observed with prior art Fe—Mn alloys which have a critical corrosion current in $H_2SO_4$ medium (2 mol·l$^{-1}$) greater than about 350 mA/cm$^2$ and a pitting potential V less than or equal to −200 mV with reference to the standard hydrogen electrode (SHE).

The alloy of the invention further has satisfactory weldability and in particular good resistance to hot cracking. As explained below it exhibits a crack length of 7 mm or less with Varestraint testing under 3% plastic strain. As a result, the alloy of the invention has much greater resistance to cracking than observed with prior art Fe—Mn alloys.

More particularly, in the alloy of the invention, the manganese in a content of 32.0 weight % or less allows a mean coefficient of thermal expansion lower than $8.5\times10^{-6}$/° C. to be obtained at between −180° C. and 0° C. This coefficient of thermal expansion is satisfactory for use of the alloy in the envisaged applications and in particular for cryogenic applications.

Additionally, the manganese content higher than or equal to 25.0 weight % associated with a chromium content lower than or equal to 14.0 weight % allows good dimensional stability of the alloy to be obtained at ambient temperature and at cryogenic temperature (−196° C.). In particular, the Néel temperature of the alloy is then strictly higher than 40° C., there being no risk of this point being reached at the usual temperatures of use of the alloy. Use of the alloy at temperatures higher than the Néel temperature risks generating major variations in the expansion of parts and assemblies welded at ambient temperature. The coefficient of expansion of high-manganese steel described above is in the region of $8\times10^{-6}$/° C. at temperatures lower than or equal to the Néel temperature, whereas it is in the region of $16\times10^{-6}$/° C. for temperatures higher than the Néel temperature.

Chromium, in a content equal to or less than 14.0 weight %, allows good KCV toughness to be obtained on a reduced test specimen of 3 mm thickness and at cryogenic temperature (−196° C.), KCV toughness at −196° C. in particular being equal to or greater than 50 J/cm$^2$. On the contrary, the inventors have ascertained that a chromium content strictly higher than 14.0 weight % risks leading to an alloy that is too brittle at cryogenic temperature.

In addition, in a content higher than or equal to 7.0 weight % chromium allows good weldability to be obtained. The inventors have found that weldability tends to deteriorate with chromium contents of strictly less than 7.0 weight %. Chromium also contributes towards improving the alloy's resistance to corrosion.

Preferably, the chromium content is between 8.5 and 11.5 weight %. A chromium content within this range leads to an even better trade-off between high Néel temperature and high corrosion resistance.

Nickel in a content equal to or less than 2.5 weight % allows a mean coefficient of thermal expansion to be obtained at between −180° C. and 0° C. that is lower than or equal to $8.5\times10^{-60}$/C. This coefficient of thermal expansion is satisfactory for use of the alloy in the envisaged applications. On the contrary, the inventors have found that there is a risk of deterioration of the coefficient of thermal expansion with nickel contents strictly higher than 2.5 weight %.

Preferably the nickel content is between 0.5 and 2.5 weight %. A nickel content higher than or equal to 0.5 weight % further improves the toughness of the alloy at cryogenic temperature (−196° C.).

Nitrogen in contents higher than or equal to 0.05 weight % contributes towards improving corrosion resistance. However, the content thereof is limited to 0.30 weight % to maintain satisfactory weldability and toughness at cryogenic temperature (−196° C.).

Preferably, the nitrogen content is between 0.15 and 0.25 weight %. A nitrogen content within this range allows an even better trade-off to be obtained between mechanical properties and corrosion resistance.

Silicon, present in the alloy in a content of between 0.1 and 0.5 weight % acts as deoxidizer in the alloy.

Optionally, the alloy contains rare earths in a content of between 0.010 and 0.14 weight %. The rare earths are preferably selected from among yttrium (Y), cerium (Ce), lanthanum (La), praseodymium (Pr), neodymium (Nd), samarium (Sm) and ytterbium (Yb) or the mixtures of one or more of these elements. In one particular example, the rare earths comprise a mixture of cerium and lanthanum, or yttrium used alone or in a mixture with cerium or lanthanum.

In particular the rare earths consist of lanthanum and/or yttrium, the sum of the contents of lanthanum and yttrium being between 0.010 and 0.14 weight %.

As a variant, the rare earths consist of cerium, the cerium content being between 0.010 and 0.14 weight %.

As a variant, the rare earths consist of a mixture of lanthanum, yttrium, neodymium and praseodymium, the sum of the contents of lanthanum, yttrium, neodymium and praseodymium being between 0.010 and 0.14 weight %. In this case, the rare earths are added for example in the form of a Mischmetal in a content of between 0.010 and 0.14 weight %. The Mischmetal contains lanthanum, yttrium, neodymium and praseodymium in the following proportions: Ce: 50%, La: 25%, Nd: 20% and Pr: 5%.

The presence of rare earths, and more particularly of a mixture of cerium and lanthanum or yttrium in the above-mentioned contents, allows an alloy to be obtained having very good resistance to hot cracking and therefore further improved weldability.

For example, the content of rare earths is between 150 ppm and 800 ppm.

The alloy of the invention can be prepared using any suitable method known to persons skilled in the art.

For example, it is prepared in an electric arc furnace followed by ladle refining employing usual methods (decarburization, deoxidization, and desulfurization) which can in particular comprise a step to apply reduced pressure. As a variant, the alloy of the invention is prepared in a vacuum furnace from raw materials with low residuals.

A hot or a cold rolled strip is then manufactured from the prepared alloy.

For example, the following method is used to manufacture said hot or cold rolled strip.

The alloy is cast in the form of semi-finished products such as ingots, remelt electrodes, slabs, in particular thin slabs having a thickness of less than 200 mm obtained in particular by continuous casting, or billets.

When the alloy is cast in the form of remelt electrodes these are advantageously remelted under a vacuum or in electroconductive slag to obtain better purity and more homogeneous semi-finished products.

The semi-finished product thus obtained is hot rolled at a temperature of between 950° C. and 1220° C. to obtain a hot rolled strip.

The thickness of the hot rolled strip is particularly between 2 mm and 6.5 mm.

In one embodiment, hot rolling is preceded by chemical homogenization heat treatment at a temperature of between 950° C. and 1220° C. for a time of between 30 minutes and 24 hours. Chemical homogenization is particularly performed on slabs, in particular thin slab.

The hot rolled strip is cooled to ambient temperature to form a cold rolled strip and wound into coils.

Optionally, the cold rolled strip is afterwards cold rolled to obtain the cold rolled strip having a final thickness of advantageously between 0.5 mm and 2 mm. Cold rolling is performed in a single pass or several successive passes.

In its final thickness the cold rolled strip is optionally subjected to recrystallization heat treatment in a static furnace for a time ranging from 10 minutes to several hours at a temperature higher than 700° C. As a variant, it is subjected to recrystallization heat treatment in a continuous annealing furnace for a time ranging from a few seconds to about 1 minute, at a temperature higher than 900° C. in the furnace soaking zone, and under a protective atmosphere of N2/H2 type (30%/70%) with a frost point of between −50° C. and −15° C. The frost point defines the partial water vapour pressure contained in the heat treatment atmosphere.

Recrystallization heat treatment can be carried out under the same conditions when cold rolling to an intermediate thickness of between the initial thickness (corresponding to the thickness of the hot rolled strip) and the final thickness. The intermediate thickness is chosen to be 1.5 mm for example when the final thickness of the cold rolled strip is 0.7 mm.

The method for preparing the alloy and the manufacture of hot and cold rolled strip in this alloy are given solely as examples.

All other methods for this purpose known to skilled persons can be used for preparing the alloy of the invention and for manufacturing end products in this alloy.

The invention also relates to a strip, in particular a hot rolled or cold rolled strip, made from the alloy such as described above.

In particular, the strip has a thickness of 6.5 mm or less, and preferably of 3 mm or less.

For example, said strip is a cold rolled strip manufactured according to the above-described method, or hot rolled strip obtained after the hot rolling step of the above-described method.

The invention also relates to a wire made from the above-described alloy.

More particularly, the wire is a filler wire used for welding parts together.

As a variant, the wire is intended for the manufacture of bolts or screws, these bolts and screws being obtained in particular by cold heading this wire.

For example, said wire is manufactured by implementing a method comprising the following steps:

providing a semi-finished product in an alloy such as described above;

hot working this semi-finished product to form an intermediate wire; and working the intermediate wire into wire of smaller diameter than the intermediate wire, working comprising a wire-drawing step.

In particular the semi-finished product is an ingot or billet.

These semi-finished products are preferably formed by hot working at between 1050° C. and 1220° C. to form the intermediate wire.

In particular, at this hot working step, the semi-finished products i.e. the ingots or billets in particular are hot worked to reduce the cross-section, imparting thereto a square cross-section for example with sides of about 100 mm to 200 mm. In this manner a semi-finished product with reduced cross-section is obtained. The length of this semi-finished product with reduced cross-section is particularly between 10 metres and 20 metres. Advantageously, reducing the cross-section of the semi-finished products is obtained by one or more successive hot rolling passes.

The semi-finished products with reduced cross-section are then again hot worked to obtain the wire. The wire can be wire rod in particular. For example, it has a diameter of between 5 mm and 21 mm, and in particular the diameter is 5.5 mm. Advantageously, at this step the wire is produced by hot rolling on a wire rod mill.

Tests

The inventors conducted laboratory casting of alloys having compositions such as defined above, and of comparative alloys having compositions differing from the above-described compositions.

These alloys were prepared under a vacuum and hot worked by rolling to obtain a strip having a width of 35 mm and thickness of 4 mm.

This hot rolled strip was then machined to obtain a scale-free surface.

The alloy compositions of each of the tested strips are given in Table 1 below.

The inventors conducted Varestraint tests on the strip obtained following European standard FD CEN ISO/TR 17641-3 under 3.2% plastic strain to assess hot cracking resistance. They measured the entire length of crack developed during the tests and classified the strips into three categories:

strip having a total crack length after the test of 2 mm or less was considered to exhibit excellent hot cracking resistance;

strip having a total crack length after the test of between 2 mm and 7 mm was considered to exhibit good hot cracking resistance; whilst strip having a total crack length after the test strictly longer than 7 mm was considered to exhibit insufficient hot cracking resistance.

The results of these tests are given under the column headed «Varestraint Tests» in Table 1 below. In this column are denoted as follows:

«1»: strip having excellent hot cracking resistance;

«2»: strip having good hot cracking resistance;

«3 »: strip having insufficient hot cracking resistance.

Hot cracking resistance is an important aspect of the weldability of an alloy, weldability being better the greater the resistance to hot cracking.

The inventors also tested corrosion resistance by conducting potentiometric tests. For this purpose, the following tests were performed:

evaluation of generalised corrosion by measurement of critical corrosion current $J_{Mn\ steel}$ in $H_2SO_4$ medium (2 $mol \cdot l^{-1}$) and comparison of this current with the current measured for strip in Invar®-M93 ($J_{Invar\ M93}$~230 $mA/cm^2$);

evaluation of localised corrosion by measuring the pitting potential V in NaCl medium (0.02 $mol \cdot l^{-1}$) and comparison of this potential V with that for Invar®-M93 ($V_{Invar\ M93}/E_{SHE}$~40 mV), where $E_{SHE}$ is the standard potential of the hydrogen electrode.

It is recalled that Invar®-M93 has the following composition in weight percentage:

35%≤Ni≤36.5%

0.2%≤Mn≤0.4%

0.02≤C≤0.04%

0.15≤Si≤0.25% optionally

0≤C≤20%

0≤Ti≤0.5%

0.01%≤Cr≤0.5% the remainder being iron and residual elements resulting from manufacturing.

If $J_{Mn\ steel} < J_{Invar\ M93}$ and $V_{Mn\ steel}/E_{SHE} > V_{Invar\ M93}/E_{SHE}$, the tested steel is considered to be more corrosion resistant than Invar M93.

If $J_{Mn\ steel} > J_{Invar\ M93}$ or $V_{Mn\ steel}/E_{SHE} < V_{Invar\ M93}/E_{SHE}$, the tested steel is considered to be less corrosion resistant than Invar®-M93.

The results of these tests are summarised under the column headed «Corrosion resistance» in Table 1 below. In this column:

the denotation «>Invar» corresponds to strip for which $J_{Mn\ steel} < J_{Invar\ M93}$ and $V_{Mn\ steel}/E_{SHE} > V_{Invar\ M93}/E_{SHE}$;

the denotation «<Invar» corresponds to strip for which $J_{Mn\ steel} > J_{Invar\ M93}$ or $V_{Mn\ steel}/E_{SHE} < V_{Invar\ M93}/E_{SHE}$; and the denotation «~Invar» corresponds to strip for which $J_{Mn\ steel} \approx J_{Invar\ M93}$ or $V_{Mn\ steel}/E_{SHE}$ ≈ $V_{Invar\ M93}/E_{SHE}$.

The inventors also performed toughness tests at −196° C. on reduced test specimens (thickness ~3.5 mm) and measured impact fracture energy of the strip (denoted KCV) in accordance with standard NF EN ISO 148-1. Fracture energy is expressed in $J/cm^2$. It translates the toughness of the strip. The results of these tests are summarised under the column headed «KCV at −196° C.» in Table 1 below.

The inventors also conducted dilatometry tests:

from −180° C. to 0° C. to determine the mean coefficient of thermal expansion of the alloy; and from 20° C. to 500° C. to determine the Néel temperature $T_{Néel}$ of the alloy. The Neel temperature corresponds to the temperature above which an antiferromagnetic material becomes paramagnetic.

More particularly the mean coefficient of thermal expansion is determined by measuring the variation in length in micrometres at between −180° C. and 0° C. of a test specimen having a length of 50 mm at 0° C. The mean coefficient of thermal expansion is then obtained by applying the following formula:

$$\frac{1}{L_0} \times \frac{L_0 - L_1}{T_0 - T_1}$$

where $L_0$-$L_1$ represents the variation in length in micrometres between 0° C. and −180° C., $L_0$ represents the length of the test specimen at 0° C., $T_0$ is 0° C. and $T_1$ is −180° C.

The Néel temperature is determined by measuring L(T), where L is the length of the specimen at temperature T, then calculating the slope dL/dT. The Néel temperature corresponds to the temperature of the change in slope of this curve.

The results of these tests are respectively given under the columns headed «CTE [−180° C. to 0° C.]» and «$T_{Néel}$» in Table 1 below.

Finally, the inventors conducted mechanical planar tension tests at −196° C. to measure yield strength at 0.2% elongation $Rp_{0.2}$ at −196° C. The results of these tests are summarised under the column headed «$Rp_{0.2}$ at −196° C.» in Table 1 below.

of thermal expansion CTE between −180° C. and 0° C. lower than or equal to $8.5\times10^{-6}$/° C., a Néel temperature higher than or equal to 40° C., KCV toughness at −196° C. greater than or equal 80 J/cm$^2$ and a yield strength $Rp_{0.2}$ at −196° C. greater than or equal to 700 MPa.

Strip made in the alloy of the invention therefore displays satisfactory properties of thermal expansion, toughness and mechanical strength for use thereof in applications in which high dimensional stability is required under the effect of variations in temperature, in particular at cryogenic temperature.

TABLE 1

Alloy compositions and test results

| No | Fe | Mn | Cr | Ni | N | Ce+ La | Y | Si | C | Al | Se S P O | Oth- ers | Var- es- traint test | Corro- sion resis- tance | KCV at −196° C. (J/cm$^2$) | $T_{Néel}$ (° C.) | CTE [−180° C. to 0° C.] ($10^{-6}$/° C.) | $Rp_{0.2}$ at −196° C. (Mpa) |
|---|---|---|---|---|---|---|---|---|---|---|---|---|---|---|---|---|---|---|
| 1 | Bal. | 25.0 | 3.6 | 0.18 | mini | mini | mini | 0.30 | 0.4 | mini | mini | mini | 3 | <Invar | n.d. | n.d. | n.d. | n.d. |
| 2 | Bal. | 25.0 | 3.6 | 0.18 | mini | mini | mini | 0.30 | mini | mini | mini | mini | 3 | <Invar | n.d. | n.d. | n.d. | n.d. |
| 3 | Bal. | 23.0 | 6.5 | 0.18 | mini | mini | mini | 0.28 | 0.45 | mini | mini | mini | 3 | <Invar | n.d. | 58 | n.d. | n.d. |
| 4 | Bal. | 23.0 | 6.5 | 0.18 | mini | mini | mini | 0.28 | mini | mini | mini | mini | 3 | <Invar | n.d. | 60 | n.d. | n.d. |
| 5 | Bal. | 28.0 | 6.5 | 2.1 | 0.1 | mini | mini | 0.25 | mini | mini | mini | mini | 3 | >Invar | 120 | 88 | 8.5 | 710 |
| 6 | Bal. | 28.0 | 8.0 | 2.1 | 0.1 | mini | mini | 0.25 | mini | mini | mini | mini | 2 | >Invar | 122 | 72 | 8.4 | 740 |
| 7 | Bal. | 28.0 | 10.2 | 1.8 | mini | mini | mini | 0.30 | mini | mini | mini | mini | 2 | <Invar | n.d. | n.d. | n.d. | n.d. |
| 8 | Bal. | 28.0 | 10.2 | 1.8 | 0.1 | mini | mini | 0.30 | mini | mini | mini | mini | 2 | >Invar | 125 | 62 | 8.3 | 760 |
| 9 | Bal. | 28.0 | 12.1 | 1.8 | 0.35 | mini | mini | 0.30 | mini | mini | mini | mini | 3 | >Invar | <50 | 52 | 8.3 | 1220 |
| 10 | Bal. | 28.0 | 13.5 | 2.0 | 0.1 | mini | mini | 0.28 | mini | mini | mini | mini | 2 | >Invar | 120 | 42 | 8.3 | 815 |
| 11 | Bal. | 28.0 | 16.0 | 2.0 | 0.1 | mini | mini | 0.28 | mini | mini | mini | mini | 2 | >Invar | <50 | <40 | 9.2 | 1260 |
| 12 | Bal. | 27.8 | 10.1 | 0.3 | 0.15 | mini | mini | 0.26 | mini | mini | mini | mini | 2 | >Invar | 120 | 75 | 7.7 | 880 |
| 13 | Bal. | 27.8 | 10.1 | 2.8 | 0.15 | mini | mini | 0.26 | mini | mini | mini | mini | 2 | >Invar | n.d. | n.d. | 8.8 | 875 |
| 14 | Bal. | 22.0 | 9.9 | 2.0 | 0.15 | 0.015 | mini | 0.20 | mini | mini | mini | mini | 1 | >Invar | 115 | <40 | 8.1 | 690 |
| 15 | Bal. | 25.5 | 9.9 | 2.0 | 0.15 | 0.035 | mini | 0.20 | mini | mini | mini | mini | 1 | >Invar | 122 | 51 | 8.3 | 815 |
| 16 | Bal. | 28.0 | 10.0 | 1.8 | 0.15 | 0.050 | mini | 0.25 | mini | mini | mini | mini | 1 | >Invar | 95 | 61 | 8.3 | 880 |
| 17 | Bal. | 31.5 | 10.0 | 1.8 | 0.15 | 0.075 | mini | 0.25 | mini | mini | mini | mini | 1 | >Invar | 105 | 70 | 8.4 | 1020 |
| 18 | Bal. | 31.5 | 10.0 | 1.8 | 0.15 | 0.150 | mini | 0.25 | mini | mini | mini | mini | 3 | >Invar | 95 | 72 | 8.4 | 990 |
| 19 | Bal. | 28.0 | 9.5 | 1.9 | 0.2 | mini | 0.040 | 0.24 | mini | mini | mini | mini | 1 | >Invar | 100 | 63 | 8.3 | 1010 |
| 20 | Bal. | 28.0 | 9.5 | 1.9 | 0.2 | mini | 0.080 | 0.24 | mini | mini | mini | mini | 1 | >Invar | 105 | 64 | 8.4 | 980 |
| 21 | Bal. | 28.0 | 9.5 | 1.9 | 0.2 | mini | 0.200 | 0.24 | mini | mini | mini | mini | 3 | >Invar | 85 | 63 | 8.3 | 1000 |

In Table 1 above, «n.d.» means that the value under consideration was not determined.

Underlined tests are those conforming to the invention.

In this Table:

for elements C, Al, Se, S, P, O, «mini» means:

C<0.05 weight %,

Al<0.02 weight %,

Se<0.001 weight %,

S<0.005 weight %,

P<0.04 weight %,

O<0.002 weight %, the elements denoted «Others» include Co, Cu, Mo, Sn, Nb, V, Ti and Pb, and in this column «mini» means:

Co, Cu, Mo<0.2 weight %,

Sn, Nb, V, Ti<0.02 weight %, and

Pb<0.001 weight %.

For nitrogen, «mini» means N<0.03 weight. At these contents, nitrogen is considered to be a residual element.

For the rare earths, namely Ce, La and Y, «mini» means that the alloy comprises no more than traces of these elements, preferably a content of each of these elements of 1 ppm or less.

The tests numbered 6, 8, 10, 12, 15 to 17, 19 and 20 conform to the invention.

It is ascertained that the strip prepared in these tests exhibits good and even excellent hot cracking resistance (cf. Varestraint test column), and therefore has good weldability.

In addition, this strip shows corrosion resistance that is greater than or equal to that of Invar M93, a mean coefficient The alloys in tests numbered 1 to 5 have a chromium content of strictly less than 7.0 weight %. It is found that the corresponding strip has poor hot cracking resistance and therefore scarcely satisfactory weldability. Tests 1 and 3 also show that this poor hot cracking resistance is not offset by the addition of carbon even at relatively high levels.

The alloy in test 11 has a chromium content strictly higher than 14.0 weight %. It can be seen that the corresponding strip shows major brittleness at cryogenic temperature translating as KCV toughness of strictly less than 50 J/cm$^2$. It is also observed that this alloy has a Néel temperature strictly lower than 40° C.

The alloy in test number 13 has a nickel content strictly higher than 2.5 weight %. It is observed that the corresponding strip has a mean coefficient of thermal expansion CTE between −180° C. and 0° C. that is strictly higher than $8.5\times10^{-6}$/° C.

Comparison between tests 7 and 8 shows that, all else being equal, the increase in nitrogen content allows improved corrosion resistance. The alloy in test number 9 has a nitrogen content strictly higher than 0.30 weight % and it is seen to display deteriorated weldability and KCV toughness at −196° C.

Also, as shown by the comparison of tests 14 and 15, a reduction in manganese content, all else being equal, results in lowering of the Néel temperature.

It is also observed that the strip corresponding to tests 14, 17, 19 and 20, which comprise rare earths in proportions of between 0.010 and 0.14 weight % have excellent hot cracking resistance with crack lengths of less than 2 mm. On the contrary, the strip corresponding to tests 18 and 21 has a rare earth content strictly higher than 0.14 weight and it is found that such strip has deteriorated weldability.

The mechanical strength of a homogeneous weld between two parts in the iron-manganese alloy of the invention or of a heterogeneous weld between a part in the iron-manganese alloy of the invention and a part in a different alloy, and in particular 304 stainless steel and Invar® M93, was investigated by tensile testing. These tests were conducted using the alloy of Example 16 in Table 1 as iron-manganese alloy.

More particularly, homogenous welds were obtained by welding together end-to-end two test bars taken from strip in the iron-manganese alloy of Example 16 in Table 1. Heterogenous welds were also obtained by welding together end-to-end a test bar taken from strip in the alloy of Example 16 in Table 1 and a test bar taken from strip in Invar® M93 or a test bar taken from strip in 304L stainless steel.

For comparison, homogenous welds were obtained by welding together two test bars taken from strip in Invar® M93 and heterogeneous welds by welding together end-to-end a test bar taken from strip in Invar® M93 and a test bar taken from strip in 304L stainless steel.

The results are given in Table 2 below.

TABLE 2

Results of tensile testing

| Type of end-to-end welded assembly | Example 16-Example 16 | Example 16-304L SS | Example16-Invar M93 | Invar M93-Invar M93 | 304L SS-Invar M93 |
|---|---|---|---|---|---|
| Mechanical strength Rm of the assembly welded at 25° C. (MPa) | 615 | 475 | 425 | 410 | 330 |

The tensile tests were performed at ambient temperature as is usual for weld qualification tests.

These tests show that the alloy of the invention has satisfactory weldability with the stainless steel and with Invar®.

The alloy of the invention can advantageously be used in any application in which good dimensional stability is required associated with good corrosion resistance and good weldability, in particular in the cryogenic range or in the field of electronics.

Having regard to their properties, the alloys of the invention can advantageously be used for the manufacture of welded assemblies intended for applications in which high dimensional stability is required under the effect of variations in temperature, in particular at cryogenic temperature.

The invention claimed is:

1. An iron-manganese alloy comprising, by weight:

25.0%≤Mn≤32.0%

7.0%≤Cr≤14.0%

0≤ Ni≤2.5%

0.15%≤N≤0.30%

0.1≤Si≤0.5%,

C≤0.05%, as an impurity, the remainder being iron and residual elements resulting from manufacturing, wherein the alloy has an average coefficient of thermal expansion CTE between −180° C. and 0° C. less than or equal to $8.5.10^{-6}$/° C., wherein the alloy has a Neel temperature greater than or equal to 40° C., and wherein the alloy is such that Varestraint tests carried out according to European standard FD CEN ISO/TR 17641-3 under 3.2% plastic strain result in a total crack length greater than 7 mm.

2. The alloy according to claim 1, wherein the chromium content is between 8.5 and 11.5 weight %.

3. The alloy according to claim 1, wherein the nickel content is between 0.5 and 2.5 weight %.

4. The alloy according to claim 1, wherein the nitrogen content is between 0.15 and 0.25 weight %.

5. The alloy according to claim 1, further comprising one or more rare earths selected from among: lanthanum, cerium, yttrium, praseodymium, neodymium, samarium and ytterbium.

6. The iron-manganese alloy of claim 1, further comprising, by weight:

0.010%≤rare earths≤0.14%.

7. The alloy according to claim 2, wherein the nickel content is between 0.5 and 2.5 weight %.

8. The alloy according to claim 2, wherein the nitrogen content is between 0.15 and 0.25 weight %.

9. The alloy according to claim 3, wherein the nitrogen content is between 0.15 and 0.25 weight %.

10. The alloy according to claim 2, further comprising one more rare earths selected from among: lanthanum, cerium, yttrium, praseodymium, neodymium, samarium and ytterbium.

11. The alloy according to claim 3, further comprising one or more rare earths selected from among: lanthanum, cerium, yttrium, praseodymium, neodymium, samarium and ytterbium.

12. The alloy according to claim 4, further comprising one or more rare earths selected from among: lanthanum, cerium, yttrium, praseodymium, neodymium, samarium and ytterbium.

13. A strip made from an iron-manganese alloy according to claim 1.

14. A wire made from an iron-manganese alloy according to claim 1.

15. A method for manufacturing a strip made from an iron-manganese alloy according to claim 1, the method comprising:

preparing the alloy;

forming a semi-finished product of said alloy; and hot rolling this semi-finished product to obtain a hot rolled strip.

16. The method of claim 15, further comprising cold rolling the hot rolled strip in one or more passes to obtain a cold rolled strip.

17. A method for manufacturing a wire made from an iron-manganese alloy according to claim 1, the method comprising the following steps:

providing a semi-finished product made from an iron-manganese alloy according to claim 1;

hot working this semi-finished product to form an intermediate wire; and working the intermediate wire into a wire of smaller diameter than the intermediate wire, said working step comprising a wire-drawing step.

18. A method for manufacturing a strip made from an iron-manganese alloy according to claim 2, the method comprising:

preparing the alloy;

forming a semi-finished product of said alloy; and hot rolling this semi-finished product to obtain a hot rolled strip.

19. A method for manufacturing a strip made from an iron-manganese alloy according to claim 3, the method comprising:

preparing the alloy;

forming a semi-finished product of said alloy; and hot rolling this semi-finished product to obtain a hot rolled strip.

20. A method for manufacturing a strip made from an iron-manganese alloy according to claim 4, the method comprising:

preparing the alloy;

forming a semi-finished product of said alloy; and hot rolling this semi-finished product to obtain a hot rolled strip.

* * * * *